US011802252B2

(12) United States Patent
Serve et al.

(10) Patent No.: US 11,802,252 B2
(45) Date of Patent: Oct. 31, 2023

(54) FUEL COMPOSITION RICH IN AROMATIC COMPOUNDS, PARAFFINS AND ETHERS, AND USE THEREOF IN MOTOR VEHICLES

(71) Applicant: TOTALENERGIES ONETECH, Courbevoie (FR)

(72) Inventors: Lisa Serve, Givors (FR); Géraldine Delorme, Solaize (FR); Florent Picard, Solaize (FR)

(73) Assignee: TotalEnergies OneTech, Puteaux (FR)

( * ) Notice: Subject to any disclaimer, the term of this patent is extended or adjusted under 35 U.S.C. 154(b) by 0 days.

(21) Appl. No.: 17/855,990

(22) Filed: Jul. 1, 2022

(65) Prior Publication Data

US 2022/0389340 A1 Dec. 8, 2022

(30) Foreign Application Priority Data

Jul. 2, 2021 (FR) ..... 2107178

(51) Int. Cl.
*C10L 10/02* (2006.01)
*C10L 1/185* (2006.01)

(52) U.S. Cl.
CPC ..... *C10L 1/1852* (2013.01); *C10L 10/02* (2013.01); *C10L 2200/0469* (2013.01)

(58) Field of Classification Search
CPC ..... C10G 2300/1014; C10L 1/023; C10L 1/1608; C10L 1/1852; C10L 10/02; C10L 2200/0469; C10L 2230/22; C10L 2270/023
See application file for complete search history.

(56) References Cited

U.S. PATENT DOCUMENTS

| | | | | |
|---|---|---|---|---|
| 4,812,146 | A | 3/1989 | Jessup | |
| 2009/0277078 | A1 | 11/2009 | Schweiger et al. | |
| 2010/0307053 | A1 | 12/2010 | Kuberka et al. | |
| 2022/0017831 | A1* | 1/2022 | Kiiski | C10L 1/08 |

FOREIGN PATENT DOCUMENTS

| | | | | |
|---|---|---|---|---|
| AU | 2020203806 | A1 * | 7/2020 | |
| EP | 680506 | B1 | 1/1997 | |
| EP | 860494 | A1 | 8/1998 | |
| EP | 915944 | A1 | 5/1999 | |
| FR | 1257865 | A1 | 4/1961 | |
| FR | 2772783 | A1 | 6/1999 | |
| FR | 2772784 | A1 | 6/1999 | |
| FR | 2987369 | A1 * | 8/2013 | C10L 1/023 |
| FR | 2987369 | A1 | 8/2013 | |
| FR | 3080382 | A1 * | 10/2019 | C10L 1/06 |
| FR | 3080382 | A1 | 10/2019 | |
| WO | 9804656 | A1 | 2/1998 | |
| WO | WO-9804656 | A1 * | 2/1998 | C10L 1/14 |
| WO | 2010014501 | A1 | 2/2010 | |

OTHER PUBLICATIONS

FR2987369A1 English Translation (Year: 2013).*
FR3080382A1 English Translation (Year: 2019).*
WO9804656A1 English Translation (Year: 1998).*

* cited by examiner

*Primary Examiner* — Ellen M McAvoy
*Assistant Examiner* — Chantel L Graham
(74) *Attorney, Agent, or Firm* — Hahn Loeser & Parks LLP; Bret A. Hrivnak

(57) ABSTRACT

The object of the present invention is a fuel composition comprising:

(i) from 50 to 79% by mass of a mixture of hydrocarbons comprising:
  a) from 35 to 55% by mass of aromatic compounds;
  b) from 30 to 50% by mass of non-cyclic paraffins containing at least 5 carbon atoms; and
  c) from 5 to 15% by mass of naphthenes;

(ii) from 20 to 40% by mass of one or more ethers; and (iii) from 1 to 10% by mass of butane.

This composition is useful for supplying a controlled-ignition engine, in automobile vehicles intended for general-public applications or for competition.

20 Claims, No Drawings

FUEL COMPOSITION RICH IN AROMATIC COMPOUNDS, PARAFFINS AND ETHERS, AND USE THEREOF IN MOTOR VEHICLES

The object of the present invention is a fuel composition intended for vehicles including a controlled-ignition engine (or gasoline engine), and which has advantageous properties.

Another object of the invention is the use of such a composition for supplying a controlled-ignition engine, both in a conventional vehicle, in particular an automobile, and in a competition vehicle.

Fuels of the gasoline type that can be used in controlled-ignition engines, in particular those in automobiles, must have sufficiently high octane ratings to avoid knocking phenomena.

In a manner well known per se, the octane number measures the resistance to self-ignition of a fuel used in a controlled-ignition engine.

Typically, gasoline fuels sold in Europe, in accordance with EN 228, have a motor octane number (or MON) above 85 and a research octane number (or RON) of a minimum of 95. These fuels are suitable for the great majority of automobile engines.

In order to increase their efficiency, modern controlled-ignition engines tend to operate with volumetric compression ratios that are increasingly high, i.e. with a high compression ratio applied to the fuel/air mixture in the engine before ignition thereof.

However, increasing the volumetric compression ratio in an engine increases the risks of abnormal combustion of the knocking type caused by local self-ignition of the carbonized mixture upstream of the flame front. This phenomenon creates a characteristic noise, and is likely to damage the engine.

For engines of very high power, such as engines of automobile competition vehicles, a high volumetric compression ratio is particularly sought.

For this type of engine, it is therefore essential to use fuels having high resistance to knocking and to pre-ignition, this resulting in fuels having "research" octane numbers (RON) as high as possible. If the octane numbers are insufficient, the phenomenon of knocking or auto-ignition of the fuel is likely to appear, which can significantly reduce the performance of the engine and even greatly damage it.

Moreover, for all vehicles and in particular those intended for general-public applications, it is sought more and more to use fuels formulated from bases of renewable origin, and in particular so-called "biosourced" bases, in order to meet environmental concerns and to limit the use of fossil resources. Thus, current environmental concerns are pushing consumers to seek fuels that are more environmentally friendly.

However, the use of fuel compositions using biosourced bases must not be done to the detriment of the performance of the fuel, and in particular the octane number and the power of the engine, which must be preserved or even increased.

Gasoline fuels with a high biocompound content that are most often used are the fuels comprising bioethanol, such as E85 fuels. Nevertheless, the use of these fuels represents a small part of the current automobile market.

Mixing bioethanol with a gasoline fuel of the SP95 type is known. The ethanol content is then limited to a maximum of 10% by volume in order to comply with the specifications of EN 228, in particular with regard to the incorporation of oxygenated compounds.

There is therefore a need to develop novel fuel compositions intended to supply controlled-ignition engines that make it possible to meet the requirements of modern vehicles, whether they be intended for general-public applications (private automobiles, heavy trucks, or off-road vehicles, i.e. non-road etc.) or for competition.

Thus, there is a need for fuels for controlled-ignition internal combustion engines that have a high octane number, and particularly a high RON, and which make it possible to maximize the engine power of the automobiles operating with a high volumetric compression ratio, in particular competition vehicles.

One objective of the present invention is therefore to improve the performance of gasoline fuel compositions, in particular but non-limitatively the fuel compositions intended for competition vehicles. The objective is to increase the energy content of the fuel, which will give rise to an increase in the power of the controlled-ignition engine, whether it be of the naturally aspirated type, turbocompressed, hybrid or not, during the combustion of the gasoline fuel composition in the engine.

There is moreover an increasing need to be able to formulate such compositions from bases and/or compounds of renewable origin, also referred to as biosourced compounds.

As is well known in the prior art, additives improving the octane number (or octane boosters) are typically added to the fuel compositions of the gasoline type. Organometallic compounds comprising in particular iron, lead or manganese are well known agents improving the octane number.

Thus, tetraethyl lead (TEL) has been widely used as an agent improving the octane number very effectively. However, in the majority of regions in the world, TEL and other organometallic compounds cannot now be used in fuels except in very small quantities, or even not at all, since they may be toxic, may damage the engine, and are harmful for the environment.

Agents improving the octane number that are not based on metals comprise oxygenated compounds (for example ethers and alcohols) and aromatic amines. However, these amines suffer from various drawbacks. For example, N-methylaniline (NMA), an aromatic amine, must be used at a relatively high treatment level (1.5 to 2% additive by mass/mass of fuel base) to have a significant effect on the octane number of the fuel. NMA may also be toxic.

By way of example, the document U.S. Pat. No. 4,812,146 describes unleaded gasoline fuel compositions for competition engines that comprise at least four components selected from butane, isopentane, toluene, MTBE (methyl tert-butyl ether) and an alkylate.

The document WO 2010/014501 describes unleaded gasoline fuel composition comprising at least 45% by volume branched paraffins, no more than 34% by volume of one or more mono- and di-alkylated benzenes, from 5 to 6% by volume of at least one linear paraffin having 3 to 5 carbon atoms (denoted C3-C5), one or more alkanols having from 2 to 4 carbon atoms (denoted C2-C4), in sufficient quantity to increase the AKI (from the English Anti-Knock Index) i.e. (RON+MON)/2, by at least 93. These compositions are presented as having a high torque and maximum power.

Thus, fuel compositions are sought having good intrinsic properties, i.e. without its necessarily being essential to add thereto additives improving the octane number such as those described above.

Continuing its research in the development of fuel formulations for gasoline engines, the Applicant has now discovered a composition that makes it possible to meet the above objectives.

The object of the present invention is therefore a fuel composition comprising:

(i) from 50 to 79% by mass of a mixture of hydrocarbons comprising:
  a) from 35 to 55% by mass of aromatic compounds;
  b) from 30 to 50% by mass of non-cyclic paraffins containing at least 5 carbon atoms; and
  c) from 5 to 15% by mass of naphthenes;

(ii) from 20 to 40% by mass of one or more ethers; and (iii) from 1 to 10% by mass of butane.

These compositions are intended to supply controlled ignition engines (or gasoline engines).

The fuel compositions according to the invention have high octane numbers RON (research octane number).

In uses wherein there is an upper limit on the input of fuel, in particular in the case of competition vehicles, the use of the composition according to the invention makes it possible to achieve superior power levels for the engine, at constant fuel input.

In particular, the formulation of a composition with the compounds and in the specific proportions defined above has proved to make it possible to obtain synergic performances in terms of octane number RON, net calorific value NCV and engine power.

These properties are particularly sought for uses in competition vehicles.

The composition according to the invention also has significant advantages for uses other than in competition vehicles, such as for example so-called general-public uses, in particular for private vehicles (or PVs). It can where applicable satisfy the requirements of EN 228.

It also has a low level of emissions of unwanted compounds, such as for example nitrogen oxides (NOx).

The composition according to the invention can advantageously, in whole or in part, be prepared from bases and/or compounds of renewable origin, for example of plant origin. In particular, the composition according to the invention can contain at least 50% by mass of one or more biosourced bases, preferably at least 60% by mass, more preferentially at least 65% by mass and better still at least 70% by mass of one or more biosourced bases.

Thus, it makes it possible to very substantially reduce the emissions of greenhouse gases, determined in accordance with the Directive (EU) 2018/2001 of the European Parliament and of the Council of 11 Dec. 2018 on the promotion of the use of energy produced from renewable sources.

The reduction in the emissions of greenhouse gases obtained by means of the fuel composition of the invention is at least 50%, compared with the reference fossil fuel defined in this Directive.

Another object of the invention is the use of the composition according to the invention for supplying a controlled-ignition engine.

According to a particular embodiment, the composition according to the invention is used as a fuel for supplying a high-efficiency and high-power controlled-ignition engine, preferably an automobile competition vehicle engine.

Other objects, features, aspects and advantages of the invention will appear even more clearly from the reading of the following description and examples.

In the following, and unless otherwise indicated, the bounds of a range of values lie within this range, in particular in the expressions: "lying between . . . and . . . ", "lying in the range from . . . to . . . ", and "ranging from . . . to . . . ".

Moreover, the expressions "at least one" and "at least" used in the present description are respectively equivalent to the expressions "one or more" and "greater than or equal to".

Finally, as is known per se, a $C_N$ compound means a compound containing N carbon atoms in its chemical structure.

The Fuel Composition

The composition according to the invention contains a mixture (i) of hydrocarbons containing:

a) from 35 to 55% by mass of aromatic compounds;

b) from 30 to 50% by mass of non-cyclic paraffins containing at least 5 carbon atoms; and c) from 5 to 15% by mass of naphthenes.

These contents are expressed by mass, with respect to the mass of the mixture of hydrocarbons (i).

Such a mixture of hydrocarbons represents from 50 to 79% by mass, with respect to the total mass of the fuel composition, preferably from 55 to 75% by mass, and more preferentially from 60 to 70% by mass, with respect to the total mass of the fuel composition.

The aromatic compound or compounds (i)a) are preferably selected from alkylbenzenes comprising 7 to 12 carbon atoms. Alkylbenzenes means, as is known per se, the derivatives of benzene wherein one or more hydrogen atoms are replaced by one or more alkyl groups.

The aromatic compound or compounds can in particular be chosen from toluene (methylbenzene), ethylbenzene, xylenes (and in particular 1,2-dimethylbenzene or ortho-xylene, 1,3-dimethylbenzene or meta-xylene and 1,4-dimethylbenzene or para-xylene), 1-ethyl-3-methylbenzene, mesitylene (1,3,5-trimethylbenzene), 1-ethyl-3,5-dimethylbenzene, and mixtures of these compounds.

Mixtures of aromatic compounds are particularly preferred, and more particularly mixtures of alkylbenzenes comprising 7 to 10 carbon atoms such as methylbenzene, ethylbenzene, xylenes (and in particular 1,2-dimethylbenzene or ortho-xylene, 1,3-dimethylbenzene or meta-xylene and 1,4-dimethylbenzene or para-xylene), 1-ethyl-3-methylbenzene, mesitylene (1,3,5-trimethylbenzene), and 1-ethyl-3,5-dimethylbenzene.

Preferably, the proportion of aromatic compounds (i)a) ranges from 40 to 53% by mass, preferably from 45 to 52% by mass, with respect to the mass of the mixture of hydrocarbons (i).

The composition according to the invention furthermore comprises non-cyclic paraffins (i)b) containing at least 5 carbon atoms.

"Paraffins" means, as is known per se, branched alkanes (also called iso-paraffins or iso-alkanes) and non-branched alkanes (also referred to as n-paraffins or n-alkanes).

The paraffins are preferably selected from those comprising 5 to 12 carbon atoms, more preferentially from 5 to 9 carbon atoms, and better still from 5 to 8 carbon atoms.

The paraffins can be selected from n-paraffins (or normal-paraffins, i.e. linear alkanes) and iso-paraffins (i.e. branched alkanes).

The mixtures of n-paraffins and iso-paraffins selected from those described above are particularly preferred, preferably comprising a major proportion of iso-paraffins, with a ratio by mass of the quantity of iso-paraffins to the quantity of n-paraffins greater than or equal to 3, preferably greater than or equal to 4 and better still lying in the range from 4 to 5.

The mixture of hydrocarbons (i) advantageously contains from 5 to 10% by mass paraffins and from 20 to 45% by mass isoparaffins.

Preferably, the proportion of paraffins (i)b) ranges from 32 to 45% by mass, more preferentially from 35 to 42% by mass, with respect to the mass of the mixture of hydrocarbons (i).

The composition according to the invention furthermore contains naphthenes (i)c).

"Naphthenes" means, as is known per se, cyclic alkanes (or cycloalkanes) containing from 5 to 10 carbon atoms. Preferably, the naphthenes are selected from cyclic alkanes containing from 5 to 10 carbon atoms, and more preferentially from 6 to 9 carbon atoms.

Preferably, the proportion of naphthenes (i)c) ranges from 7 to 13% by mass, more preferentially from 8 to 12% by mass, with respect to the mass of the mixture of hydrocarbons (i).

According to a preferred embodiment, the mixture of hydrocarbons (i) comes from plant raw materials. Thus, the mixture (i) advantageously consists entirely of biosourced hydrocarbons. The original plant raw materials can for example be selected from cereals (for example wheat, maize), colza, sunflower, soya, palm oil, sugarcane, beetroot, wood waste, straw, bagasse, grape marc, waste vegetable cooking oils, algae, and lignocellulosic materials. Plant raw materials containing carbohydrates, such as cereals, sugarcane, beetroot, wood waste, straw, bagasse, grape marc, and lignocellulosic materials which may come from the timber industry, are particularly preferred.

Preferably, so-called second generation (2G) or advanced plant material is used, in particular plant material that is not in competition with the food resource.

The mixture of hydrocarbons (i) is preferably obtained by transforming plant material into alcohol containing 1 to 5 carbon atoms, preferably methanol and/or ethanol, which are converted into hydrocarbons in the presence of catalysts making it possible to dehydrate the alcohols and to produce reaction intermediates which, catalytically, are next transformed into hydrocarbons.

The composition according to the invention also contains at least one ether.

Ethers, also referred to as ether-oxides or alkoxy-alkyls, are compounds of formula R—O—R', wherein R and R', identical or different, represent an alkyl radical.

According to a preferred embodiment, the ether or ethers are selected from compounds of formula R—O—R', wherein R and R', identical or different, represent a C1 to C5 alkyl radical.

Preferably, R represents a C1 or C2 alkyl radical and R' represents a C3, C4 or C5 alkyl radical.

Particularly preferably, the oxygenated compound or compounds (ii) are selected from methyl tert-butyl ether (MTBE), ethyl tert-butyl ether (ETBE), tert-amyl methyl ether (TAME), tert-amyl ethyl ether (TAEE), and mixtures of these compounds.

Ethyl tert-butyl ether (ETBE) is particularly preferred.

According to a preferred embodiment, one or more ethers of plant origin, or bioethers, are used. The ether may be obtained renewably by using, for example, a renewable alcohol, and an olefin resulting from thermal or catalytic cracking or by steam cracking of a renewable feedstock.

Bioethers may for example be produced by reaction between an alcohol and an olefin which is generally branched. They may be produced from renewable raw materials (in particular plant raw materials) using, for example, alcohols obtained by transformation (for example fermentation) of renewable raw materials, and olefins resulting from cracking (thermal or catalytic cracking or steam cracking) of a renewable feedstock, or by dehydration of an alcohol. Preferably, the olefins are produced by steam cracking of bionaphtha, which is a by-product coming from the production of renewable diesel fuel by deoxygenation and isomerization of triglycerides of plant origin.

The composition has a total ether content ranging from 20 to 40% by mass, preferably from 22 to 35% by mass, and better still from 25 to 35% by mass, with respect to the total mass of the fuel composition.

The composition according to the invention also contains butane, which can be selected from n-butane (linear butane), iso-butane (2-methylpropane) and mixtures of these two compounds.

It is preferred to use a mixture of n-butane and iso-butane.

The butane may come from renewable raw materials. It may for example be obtained by fractioning of light hydrocarbons produced by catalytic cracking during the production of renewable diesel fuel, which is obtained by deoxygenation and isomerization of triglycerides of plant origin, animal fats or used cooking oils.

The composition has a butane content ranging from 1 to 10% by mass, preferably from 1.5 to 8% by mass, and better still from 2 to 6% by mass, with respect to the total mass of the fuel composition.

According to a preferred embodiment, the composition according to the invention comprises no more than 2.5% by mass olefins, preferably no more than 2% by mass olefins, more preferentially no more than 1% by mass olefins, more preferentially still no more than 0.5% by mass olefins.

The composition as described above generally has a research octane number (RON number) greater than or equal to 95, preferably greater than or equal to 99, and more preferentially greater than or equal to 100, the RON being measured in accordance with ASTM D 2699-86.

The above values relate to the intrinsic octane number of the composition, i.e. without adding supplementary compounds such as in particular octane booster additives.

The composition according to the invention may also contain one or more alcohols, preferably selected from C1 to C6 alcohols, more preferentially from C1 to C4 alcohols.

Mention can be made in particular of methanol, ethanol, iso-propanol, and hexanol. Methanol and ethanol are particularly preferred.

According to a preferred embodiment, alcohols coming from renewable raw materials are used, and in particular of plant origin, also referred to as bioalcohols.

Such alcohols may be present in the composition according to the invention in a proportion ranging from 1 to 10% by mass, preferably from 2 to 8% by mass.

In addition to the base compounds described above, the fuel composition according to the invention may also comprise one or more additives, selected from those usually employed in gasoline fuels.

In particular, the composition according to the invention may comprise at least one detergent additive ensuring cleanliness of the engine. Such an additive may for example be selected from the group consisting of succinimides, optionally substituted by a polyisobutylene group, polyetheramines, betaines, Mannich bases and quaternary ammonium salts, for example those described in the documents U.S. Pat. No. 4,171,959 and WO 2006/135881.

The composition may also comprise at least one lubricity additive or anti-wear agent, in particular (but non-limitatively) selected from the group consisting of fatty acids and the ester or amide derivatives thereof, in particular glycerol monooleate, and the derivatives of mono- and polycyclic carboxylic acids. Examples of such additives are given in the following documents: EP680506, EP860494, WO98/04656, EP915944, FR2772783, FR2772784.

Other additives may also be incorporated in the fuel composition according to the invention, such as valve recession prevention additives, anti-oxidant additives, additives increasing the octane number, in particular selected from amines, preferably aromatic, comprising or not oxygen.

The additives described above may be added to the fuel composition in a quantity ranging, for each of them, from 10 to 5000 ppm by mass, preferably from 50 to 1000 ppm by mass and better still from 100 to 500 ppm by mass, with respect to the total mass of the fuel composition.

According to a preferred embodiment, the composition comprises at least one additive, advantageously selected from detergent additives, lubricity additives, valve recession prevention additives, anti-oxidant additives, additives increasing the octant number, and mixtures of such additives.

The fuel compositions according to the invention have a lead content generally of at most 5 mg/L (present for example in the form of tetraethyl lead) and preferably are unleaded, i.e. they do not contain lead or compound containing lead. They are also free from sulfur (maximum content 10 ppm by weight).

Preparation of the Fuel Composition

The composition according to the invention can be prepared by simple mixing of its constituents.

A first non-limitative embodiment comprises the following steps:

1) preparing a mixture of hydrocarbons (i) comprising from 35 to 55% by mass aromatic compounds, from 30 to 50% by mass non-cyclic paraffins containing at least 5 carbon atoms, and from 5 to 15% by mass naphthenes; then
2) mixing from 50 to 79% by mass of said mixture (i) with 20 to 40% by mass one or more ethers and 1 to 10% by mass butane.

A second non-limitative embodiment comprises the following steps:

1') preparing a base B comprising the mixture of hydrocarbons (i) and butane; then
2') mixing the base B with one or more ethers so that the ether content in the final composition is in the range from 20 to 40% by mass; and
3') optionally, adding butane, so that the quantity of butane in the final mixture is in the range from 1 to 10% by mass.

A preferred variant of this second embodiment comprises the following steps:

1') preparing a base B comprising the mixture of hydrocarbons (i) and butane; then
2') mixing from 60 to 80% by mass of the base B with 20 to 40% by mass of one or more ethers; and preferably from 65 to 78% by mass of said base B with 22 to 35% by mass of one or more ethers.

The second embodiment and the preferred variant thereof described above are preferred.

In this embodiment, the base B is advantageously a biosourced base, i.e. it is advantageously obtained from alcohols resulting from the fermentation of plant raw materials, and preferably plant raw materials containing carbohydrates, such as cereals, sugarcane, beetroot, wood waste, bakery waste, straw, bagasse, grape marc and lignocellulosic materials.

Such plant raw materials can be converted into biohydrocarbons by known catalytic conversion methods.

Likewise, the ether or ethers are preferably bioethers.

Thus, the composition according to the invention can be entirely prepared from raw materials of renewable origin.

The Uses

Another object of the invention is the use of the composition as described above for supplying a controlled-ignition engine. The engine may be of the direct injection type, or indirect injection.

The fuel composition can advantageously be used for supplying both an engine of a conventional automobile vehicle (so-called "general public") and a high-efficiency and high-power controlled-ignition engine, such as an automobile competition vehicle engine. It may in particular be a case of a naturally aspirated or turbocompressed engine used in a competition vehicle (circuits or rallies), or a hybrid engine, i.e. a heat engine coupled to an electric motor.

Another object of the invention is the use of the composition as described above for reducing greenhouse gas emissions, determined in accordance with the Directive EU 2018/2001 of the European Parliament and the Council of 11 Dec. 2018 on the promotion of the use of energy produced from renewable sources.

According to this Directive, the reduction in greenhouse gas emissions is determined with respect to a reference fossil fuel. The method for calculating the reduction percentage is particularly defined in annex V, part C of the Directive.

The reduction in greenhouse gas emissions obtained by means of the fuel composition of the invention is at least 50%, preferably at least 60%, and even better at least 65%, with respect to the reference fossil fuel defined in the Directive.

The following examples aim solely to illustrate the invention, and could not be interpreted as limiting the scope thereof.

EXAMPLES

The following examples were implemented using a base B of biosourced hydrocarbons resulting from the transformation of bio-alcohol resulting from the transformation of biomass.

The base B has the following composition:

TABLE 1

| Compounds | Content (% by mass) |
|---|---|
| Olefins | 2.50 |
| C6 to C11 aromatic compounds | 46.6 |
| C5 to C9 n-paraffins | 6.3 |
| C5 to C11 isoparaffins, including | 29.8 |
| C5 to C7 | 22.3 |
| Naphthenes | 12 |
| Butane, including | 2.8 |
| n-butane | 1.5 |
| isobutane | 1.3 |

A fuel composition C according to the invention was prepared, by mixing: −66% by mass of base B;

−34% by mass of ethyl tert-butyl ether (ETBE).

The fuel C according to the invention, containing a biosourced base in a very large proportion as well as ETBE, made it possible to obtain satisfactory performances in terms of net calorific value (NCV) and octane number (RON).

This composition procures a reduction of 65% in the greenhouse gas emissions, this reduction being determined in accordance with the method defined in annex V part C of the Directive (EU) 2018/2001 of the European Parliament and of the Council.

The invention claimed is:

1. A gasoline fuel composition comprising:

(i) from 50 to 79% by mass of a mixture of hydrocarbons comprising:

a) from 35 to 55% by mass of aromatic compounds;

b) 30 to 50% by mass of non-cyclic paraffins containing at least 5 carbon atoms; and c) from 5 to 15% by mass of naphthenes selected from cyclic alkanes containing from 5 to 10 carbon atoms;

(ii) from 20 to 40% by mass of one or more ethers; and (iii) from 1 to 10% by mass of butane.

2. The fuel composition according to the preceding claim, characterized in that the mixture of hydrocarbons (i) represents from 55 to 75% by mass with respect to the total mass of the fuel composition.

3. The fuel composition according to claim 1, characterized in that the aromatic compounds (i)a) are selected from alkylbenzenes comprising from 7 to 12 carbon atoms.

4. The fuel composition according to claim 1, characterized in that the proportion of aromatic compounds (i)a) ranges from 40 to 53% by mass with respect to the mass of the mixture of hydrocarbons (i).

5. The fuel composition according to claim 1, characterized in that the non-cyclic paraffins (i)b) are selected from paraffins comprising from 5 to 12 carbon atoms.

6. The fuel composition according to claim 1, characterized in that the mixture of hydrocarbons (i) contains from 5 to 10% by mass n-paraffins and from 20 to 45% by mass iso-paraffins.

7. The fuel composition according to claim 1, characterized in that the proportion of paraffins (i)b) ranges from 32 to 45% by mass with respect to the mass of the mixture of hydrocarbons (i).

8. The fuel composition according to claim 1, characterized in that the naphthenes (i)c) are selected from cyclic alkanes containing from 6 to 9 carbon atoms.

9. The fuel composition according to claim 1, characterized in that the proportion of naphthenes (i)c) ranges from 7 to 13% by mass with respect to the mass of the mixture of hydrocarbons (i).

10. The fuel composition according to claim 1, characterized in that the ether or ethers are selected from the compounds of formula R—O—R', wherein R and R', identical or different, represent a C1 to C5 alkyl radical.

11. The fuel composition according to claim 10, characterized in that the ether or ethers are selected from the compounds of formula R—O—R', wherein R represents a C1 or C2 alkyl radical and R' represents a C3, C4 or C5 alkyl radical.

12. The fuel composition according to claim 11, characterized in that the ether or ethers are selected from methyl tert-butyl ether (MTBE), ethyl tert-butyl ether (ETBE), tert-amyl methyl ether (TAME), tert-amyl ethyl ether (TAEE), and mixtures of these compounds.

13. The fuel composition according to claim 1, characterized in that its total ether content ranges from 22 to 35% by mass with respect to the total mass of the fuel composition.

14. The fuel composition according to claim 1, characterized in that its butane content ranges from 1.5 to 8% by mass with respect to the total mass of the fuel composition.

15. The fuel composition according to claim 1, characterized in that it comprises no more than 2.5% by mass olefins.

16. The fuel composition according to claim 1, characterized in that it further contains one or more alcohols.

17. The fuel composition according to claim 16, characterized in that the alcohol or alcohols are present in a proportion ranging from 1 to 10% by mass.

18. The fuel composition according to claim 1, characterized in that the mixture of hydrocarbons (i) comes from plant raw materials.

19. The fuel composition according to claim 1, characterized in that it contains at least 50% by mass of one or more biosourced bases.

20. A method of using the composition as defined in claim 1 for reducing greenhouse gas emissions, determined in accordance with the Directive (EU) 2018/2001 of the European Parliament and of the Council.

* * * * *